US005381613A

United States Patent [19]

Pozzobon et al.

[11] Patent Number: 5,381,613

[45] Date of Patent: Jan. 17, 1995

[54] SKI BOOT

[75] Inventors: Alessandro Pozzobon, Paderno Di Ponzano Veneto; Giancarlo Foscaro, Treviso; Gianpaola Marongiu, Rome; Maurizio Tacchetto, Noventa Padovana; Luca Bugliesi, Piombino, all of Italy

[73] Assignee: Nordica S.p.A., Trevignano, Italy

[21] Appl. No.: 169,957

[22] Filed: Dec. 20, 1993

Related U.S. Application Data

[63] Continuation of Ser. No. 903,204, Jun. 23, 1992, abandoned.

[30] Foreign Application Priority Data

Jul. 5, 1991 [IT] Italy ..... TV91 A 000071
Nov. 6, 1991 [IT] Italy ..... TV91 A 000120

[51] Int. Cl.[6] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 4,083,129 | 4/1978 | Collombin et al. | 36/117 |
| 4,160,332 | 7/1979 | Salomon | 36/119 |
| 4,706,393 | 11/1987 | Marxer | 36/117 |
| 4,759,137 | 7/1988 | Lederer | 36/121 |
| 4,760,653 | 8/1988 | Baggio | 36/117 |
| 4,823,484 | 4/1989 | Couty | 36/117 |
| 4,839,973 | 6/1989 | Dodge | 36/121 |
| 4,922,633 | 5/1990 | Sartor | 36/117 |
| 4,934,075 | 6/1990 | Benetti et al. | 36/117 |
| 4,949,480 | 8/1990 | Hercog et al. | 36/117 |
| 5,001,849 | 3/1991 | Bidoia | 36/117 |
| 5,005,303 | 4/1991 | Bonaventure et al. | 36/117 |
| 5,031,341 | 7/1991 | Paris et al. | 36/121 |
| 5,065,533 | 11/1991 | Paris | 36/121 |

FOREIGN PATENT DOCUMENTS

| | | | |
|---|---|---|---|
| 0213613 | 3/1987 | European Pat. Off. | 36/117 |
| 0259721 | 5/1988 | European Pat. Off. | 36/117 |

*Primary Examiner*—Paul T. Sewell
*Assistant Examiner*—Marie Denise Patterson
*Attorney, Agent, or Firm*—Guido Modiano; Albert Josif; Daniel O'Byrne

[57] ABSTRACT

A ski boot having a rear quarter which is constituted by a first half-quarter and by a second half-quarter which are mutually articulated and oscillate with respect to the shell. The second half-quarter is also articulated to the shell. The half-quarters interact with adjusting members for adjusting their mutual position, so as to achieve a better adaptation and embracing of the rear region of the lower part of the leg while skiing.

8 Claims, 7 Drawing Sheets

SKI BOOT

This is a continuation application of application Ser. No. 07/903,204 filed on Jun. 23, 1992, now abandoned.

BACKGROUND OF THE INVENTION

The present invention relates to a ski boot.

The problem of achieving easy entry of the foot and at the same time allowing optimum support for the lower part of the leg during sports practice is currently felt in ski boots.

Ski boots are known in which the rear quarter can adapt to the leg for a certain degree. French patent application No. 7719655, which claims a U.S. priority dated Jul. 12, 1976, discloses a ski boot on whose rear quarter has articulations suitable for allowing its deformation in the direction of the front quarter. However, this solution, despite allowing the rear quarter to follow the shape of the leg during forward flexing, cannot, due to abutments defined on said quarter, follow the natural arcuated shape of the leg or assist it during its backward flexing.

U.S. Pat. No. 4,095,356 discloses a ski boot whose rear quarter has an upper cuff which is pivoted laterally to the front quarter and does not affect the heel region. The rear quarter also has a wing which is pivoted transversely to the shell and affects the heel region.

This solution, too, has problems, because during backward flexing the wing is free to rotate about its own axis and therefore does not support the heel in any way.

Furthermore, during forward flexing, the wing, moved by the upper cuff with which it interacts, exerts considerable localized pressure on the heel, and this creates discomfort for the user.

European Patent No. 0278245 also discloses a ski boot having a device arranged inside the rear quarter and allowing the innerboot to adapt to the lower part of the leg by means of a movement along an axis which is longitudinal to the rear quarter.

This solution only allows to deform the padding of the innerboot and thus merely allows to achieve a static adjustment for adaptation to the anatomical shape of the leg; it does not allow in any way adaptation to, and embracing of, the rear region of the lower part of the leg during sports practice.

U.S. Pat. No. 4,839,973 discloses a ski boot constituted by a quarter which is pivoted laterally to a shell and is also articulated to the rear, about a longitudinal axis, to a cuff which is in turn pivoted laterally to said shell.

Said cuff therefore has no heel supporting function but only allows, by virtue of its articulation to the quarter, to increase the opening of said quarter.

Therefore, this function only has a static aspect and can be used during the insertion or extraction of the foot in or from the boot, European Patent No. 374056 discloses a rear-entry ski boot wherein the rear quarter is constituted by a cuff, which is pivoted together with the front quarter to the shell at a slot, and by a support, which embraces the heel region, is in turn rigidly associated with the lateral ends of the cuff and is pivoted to the shell in an underlying region.

This solution allows the cuff to rotate with respect to the support, during the opening of the quarters, until it abuts at an adapted protrusion defined on said support.

During skiing, instead, the support is locked with respect to the shell, thus univocally supporting the leg with no possibility of adaptation according to the compression or extension performed during sports practice.

The Italian Patent No. 19382A/81, which the same Applicant filed on Jan. 28, 1981 and is assumed included herein as reference, and the French Patent No. 2536965, filed on Dec. 2, 1982, are thus known; however, in said patents a problem is observed which is due to the convoluted path of the cable, which complicates the construction of the boot or requires the use of complicated and expensive adjustment mechanisms which also increase the weight of the boot.

Said known types of devices furthermore impose a pressure on the foot which is often constant both during forward and backward flexing and during rest; in practice, instead, greater pressure on the foot is required during forward flexing than during extension or rest.

Finally, during forward flexing the shell and quarters splay, especially in the ankle region; this splaying entails a reduction in the retention of the foot in the boot and thus less sensitivity in the driving of the ski.

SUMMARY OF THE INVENTION

The aim of the present invention is to eliminate the problems described above in known types by providing a ski boot which allows both optimum insertion and extraction of the foot into and out of the boot and optimum adaptation to the lower part of the leg.

Within the scope of the above aim, an important object is to provide a boot which also allows to assure optimum embracing of the rear region of the lower part of the leg while skiing.

Another important object is to provide a ski boot wherein the skier can select the degree of securing of the region above the heel according to his/her requirements while keeping the heel secured in an optimum manner even during forward or backward flexing.

Another object is to provide a ski boot which is structurally simple and easy to industrialize.

Not least object is to provide a ski boot which is reliable and safe in use and has low manufacturing costs.

A further aim of the present invention is to provide a ski boot which allows to achieve an optimum securing of the skier's ankle, foot instep and heel regions during the various phases of sports practice without requiring direct intervention by said skier.

Within the scope of the above aim, an important object is to provide a ski boot which allows the boot to maintain an optimum securing for the ankle region even during the walk required for example to cover the distance to the ski-lift.

Another important object is to provide a ski boot which optimally embraces the ankle despite the variation of the degree of flexing imposed during sports practice.

This aim, these objects and others which will become apparent hereinafter are achieved by a ski boot, characterized in that it comprises a shell and a rear quarter, said rear quarter comprising at least a first half-quarter and a second half-quarter, said half-quarters being mutually articulated and being adapted to oscillate with respect to said shell, said second half-quarter being articulated to said shell, at least one of said half-quarters having means for adjusting the mutual position of said half-quarters.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
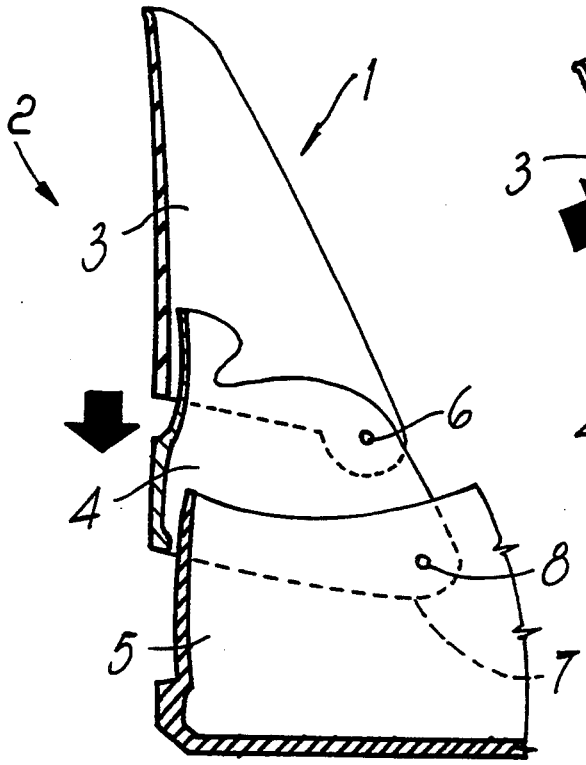
FIG. 1 is a sectional view, taken along a longitudinal median plane, of part of the shell and of the first and second half-quarters of a ski boot according to the invention.
Figure 2:
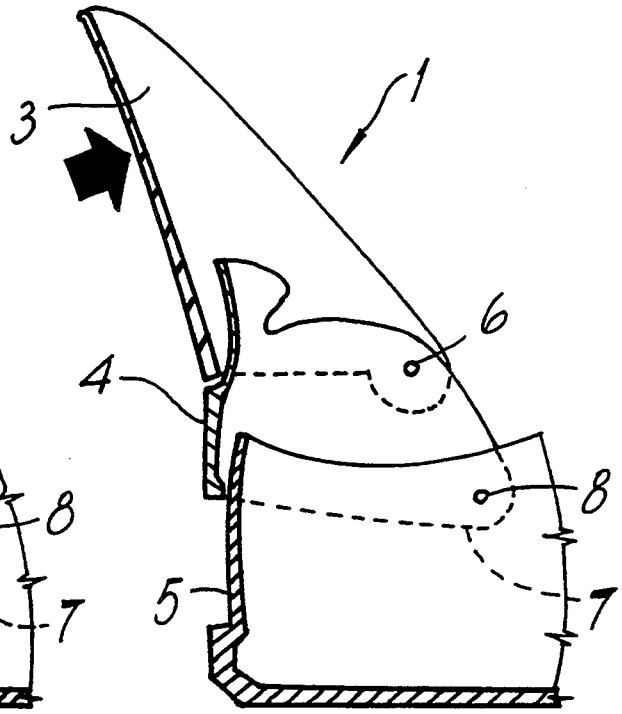
FIGS. 2 and 3 are views, similar to the preceding one, of two different arrangements of the first and second half-quarters.
Figure 3:
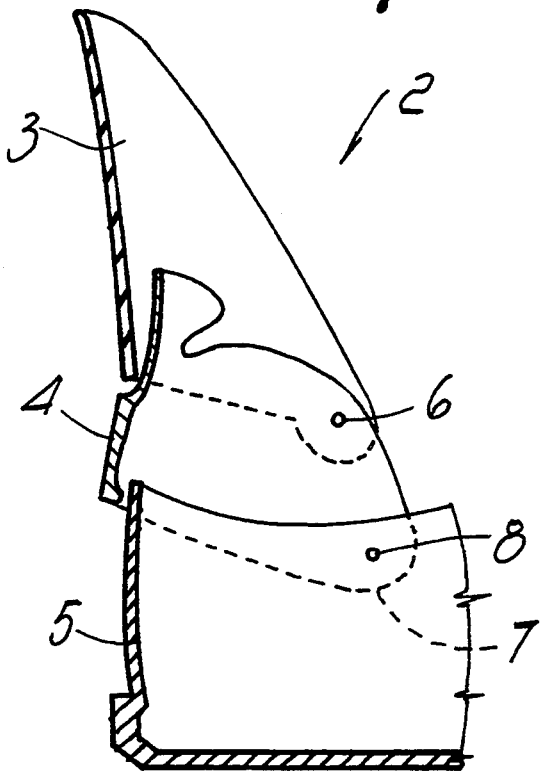

With reference to the above figures, the ski boot, generally designated by the reference numeral 1, is constituted by a rear quarter 2, which is composed of at least a first half-quarter 3 and a second half-quarter 4, by a shell 5 and by a front quarter which is not illustrated.

The first half-quarter 3 is at the rear region of the lower part of the leg and approximately embraces the calf region; said first half-quarter is pivoted, at its lower ends, laterally to the underlying second half-quarter 4 by means of adapted first rivets, or studs, 6.

The second half-quarter 4 is arranged so that its upper portion is inside the first half-quarter 3 and so that its lower portion externally embraces the underlying shell 5, and thus approximately embraces the region overlying the heel of the user.

The second half-quarter 4 is also articulated, proximate to the lower perimetric edge 7, laterally to the shell 5 by means of adapted second rivets, or studs, 8.

The mutual articulation of the first and second half-quarters and the articulation of said second half-quarter to the shell allow to give the rear quarter the most appropriate configuration according to the specific requirements encountered by the user during sports practice, because it is possible to impart distinct movements to the first half-quarter and to the second half-quarter, which can thus adapt optimally to the entire rear region of the lower part of the leg, which substantially has a concave shape.

Figure 9:
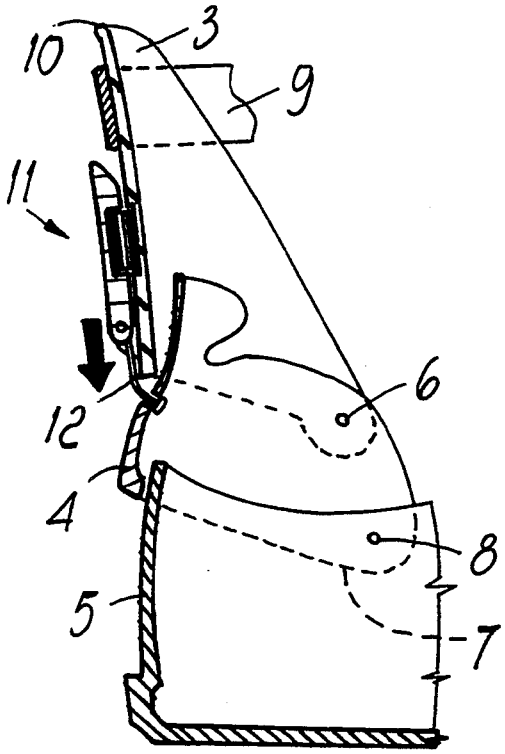
FIGS. 9, 10, 11, 12 and 13 are views of some solutions related to the means for adjusting the mutual position of the first and second half-quarters.

The ski boot also comprises means for adjusting the mutual position of the first and second half-quarters; said means are constituted, as illustrated in FIG. 9, by a traction element, such as a first band 9 which embraces the to first half-quarter 3 proximate to its upper perimetric edge 10, and by an adapted lever 11 which is articulated transversely to the rear of said first half-quarter 3.

At least one further traction element is associated with said lever 11, such as for example a cable 12 which is rigidly associated with said lever at one end and is rigidly associated, at its other end, at the underlying second half-quarter 4 in the part thereof which protrudes from the lower perimetric edge 7 of the first half-quarter 3.

The application of tension to the lever 11 in fact allows to select a certain mutual arrangement of the first and second half-quarters, for example so as to increase or not increase the securing of the heel region of the user.

Advantageously, the lever 11 can have particular devices for the fine adjustment of the length of the cable 12.

Figure 10:
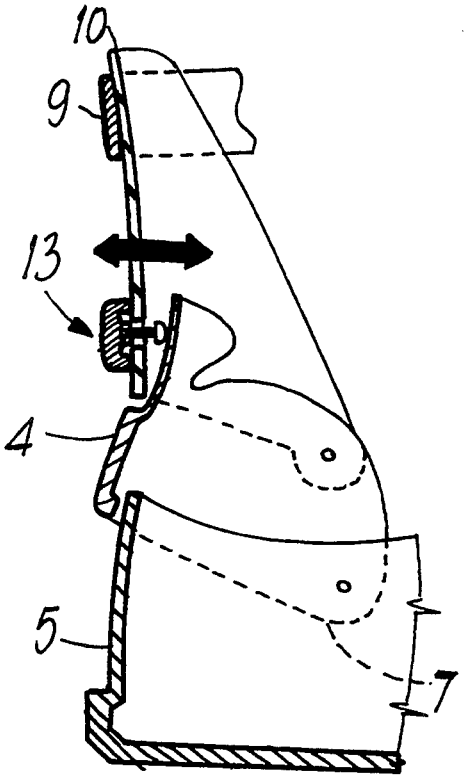

FIG. 10 illustrates other adjustment means, constituted by an adapted screw presser 13 which is associated at the rear region of the first half-quarter 3 proximate to its lower perimetric edge 7; said screw presser 13 interacts with the upper end of the second half-quarter 4, imparting thereto a given angle with respect to both the first half-quarter 3 and the underlying shell 5.

A traction element, such as a first band 9, may also still be associated with the first half-quarter 3.

Figure 11:
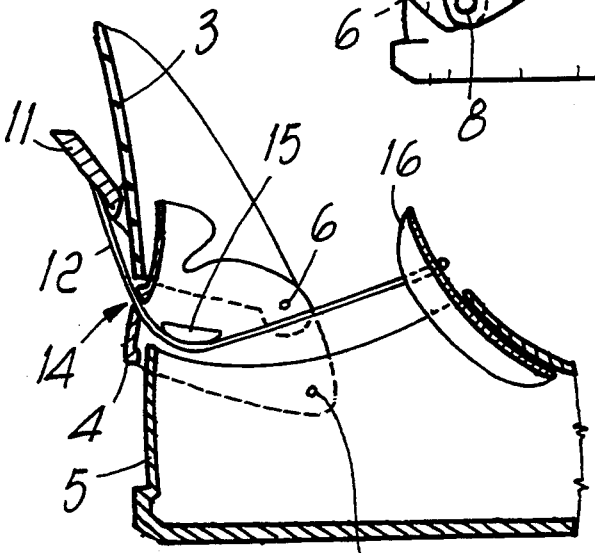

The adjustment means may furthermore be constituted, as shown in FIG. 11, by a lever 11 which is pivoted transversely to the rear of the first half-quarter 3; at least one traction element, such as a cable 12, is associated with said lever, passes inside the second half-quarter 4 through an adapted pair of first holes 14 defined to the rear of said second half-quarter and is then guided, at a pair of adapted first ridges 15 which protrude inside the second half-quarter 4, onto a presser 16 arranged at the foot instep region.

Figure 12:
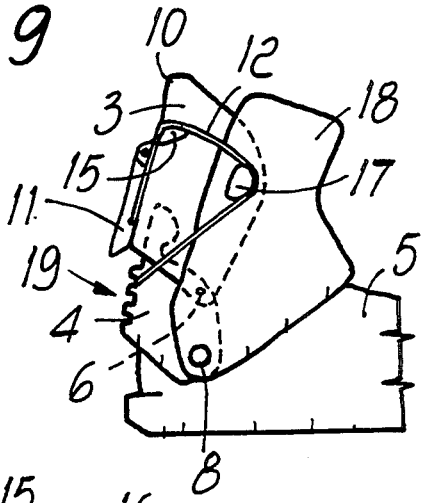

Alternatively, the adjustment means can be constituted, as illustrated in FIG. 12, again by a lever 11 which is pivoted transversely to the rear of the first half-quarter 3 proximate to its upper perimetric edge 10; at least one traction element, such as a cable 12, is associated with said lever, and said cable is guided, proximate to said upper perimetric edge 10, on a pair of first protrusions 15 and then on a pair of second protrusions 17 which protrude laterally to the front quarter 18, and is then associated at an adapted toothed region 19 defined transversely to the rear of the second half-quarter 4. It is apparent that the adjustment means are not only means for adjusting the mutual relative position of the first and second half-quarters, but such adjustment means are therefore also means for adjusting the mutual relative position of the rear quarter (comprising the first half-quarter 3 and the second half-quarter 4) with respect to the front quarter 18, since the lever 11 acts with the cable 12 to adjust the mutual relative positions of all three quarter elements comprising the first half-quarter, the second half-quarter, and the front quarter.

The invention thus allows to have a first half-quarter and a second half-quarter whose mutual position can be adjusted, said half-quarters being able to rotate with respect to the shell and possibly with respect to one another while skiing, this assuring optimum adaptation and embracing of the rear region of the lower part of the leg during both forward and backward flexing.

Figure 4:
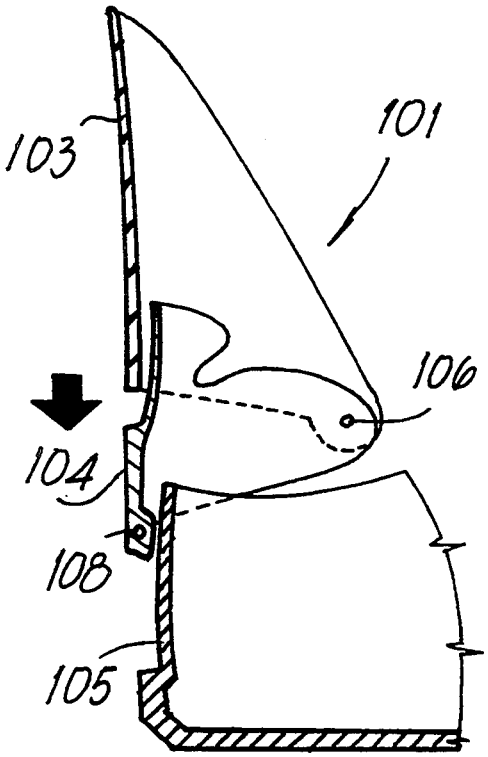
FIG. 4 is a view, similar to FIG. 1, of a further embodiment of the invention.

FIG. 4 partially illustrates a ski boot 101 which is again composed of a first half-quarter 103 which partially embraces a second half-quarter 104 and is laterally articulated thereto at adapted first rivets and/or studs 106.

The second half-quarter 104 is in turn articulated transversely to the rear of the shell 105 at adapted second rivets and/or studs and/or pivots 108.

Figure 5:
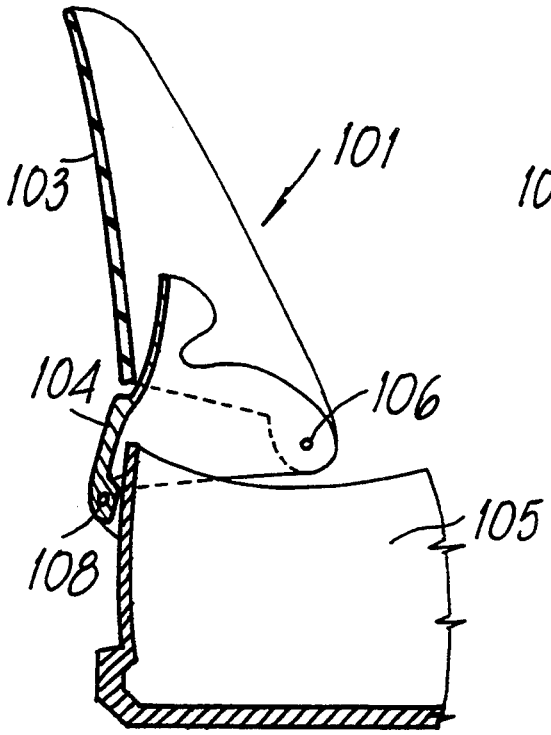
FIGS. 5 and 6 are views, similar to FIG. 4, of two different positions which can be assumed by the first and second half-quarters.
Figure 6:
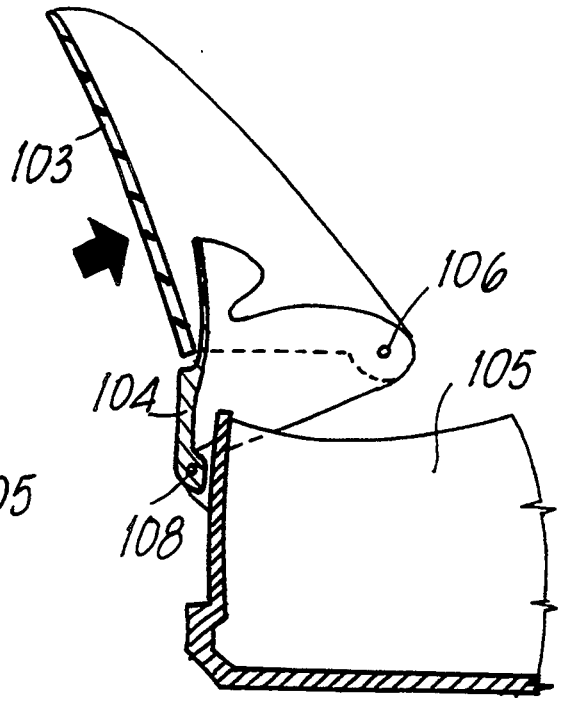

This configuration, too, allows, as shown in FIGS. 5 and 6, optimum adaptation and embracing of the rear region of the lower part of the leg as well as easy opening for foot insertion.

Figure 7:
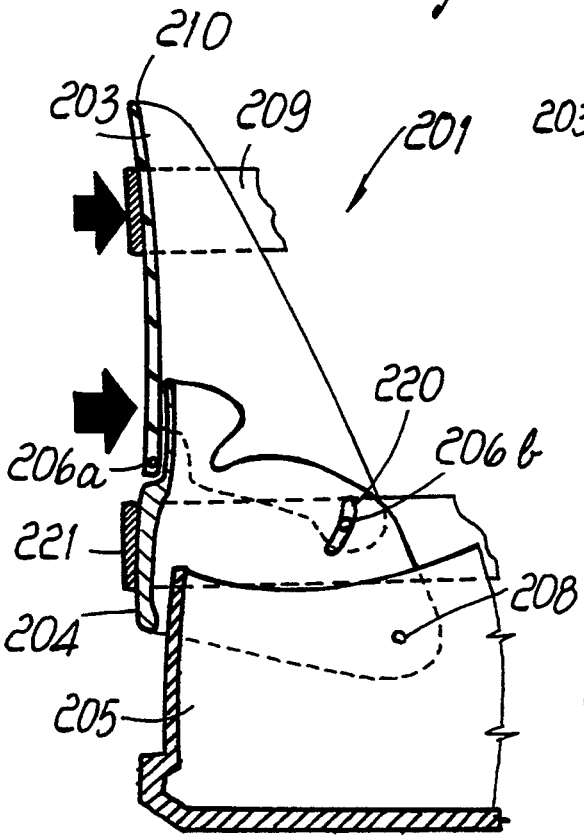
FIG. 7 is a view, similar to FIG. 1, of a further embodiment.
Figure 8:
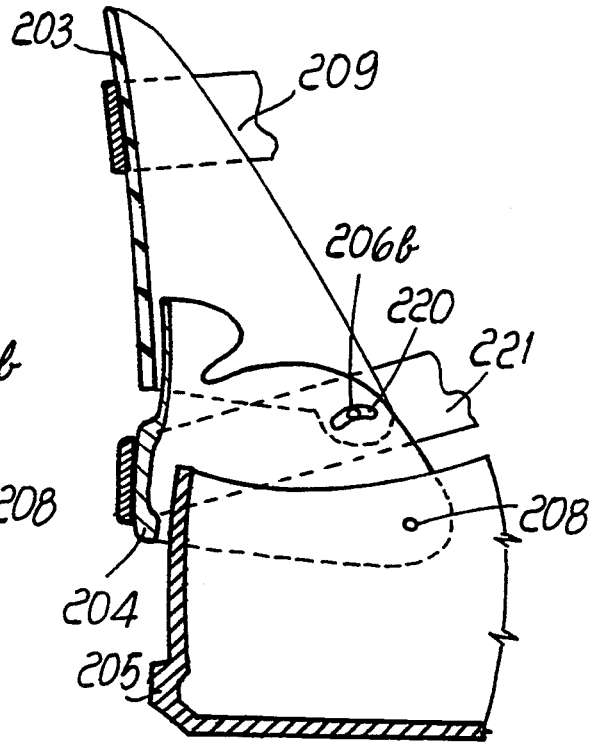
FIG. 8 is a view, similar to FIG. 1, of a further embodiment.

Alternatively, as shown in FIGS. 7 and 8, the ski boot 201 is constituted by a first half-quarter 203 which is articulated, at its lower perimetric edge, transversely to the rear of the second half-quarter 204 at adapted first rivets 206*a*.

The first half-quarter 203 is also connected laterally to the second half-quarter 204 by means of adapted first rivets 206*b* which can slide at an adapted pair of slots which are defined laterally to the second half-quarter 204 and have their concavity directed opposite to the tip of the shell 205.

The second half-quarter 204 is in turn articulated laterally at the shell 205 by means of adapted second rivets 208.

The means for adjusting the mutual position of the first half-quarter 203 and of the second half-quarter 204 may be constituted by at least one first band 209, which affects the first half-quarter 203 proximate to the upper perimetric edge 210, and by a second band 221, which embraces the second half-quarter 204.

This solution can also be applied to all the previously described variations.

Figure 13:
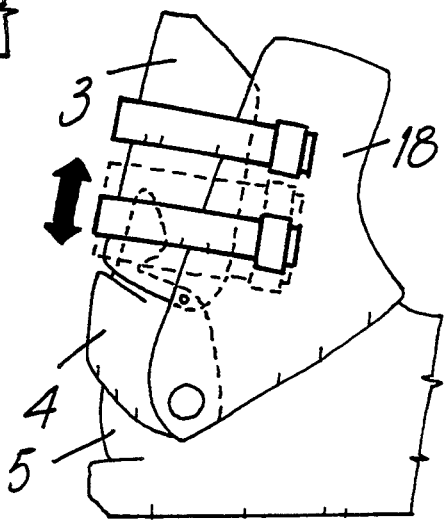

Alternatively, the adjustment means are constituted by one or more bands, which affect said first and/or second half-quarters and said front quarter; at least one of said bands interacts with known means for adjusting the position about an axis which is approximately parallel to the axis of the leg, as shown in FIG. 13.

Figure 14:
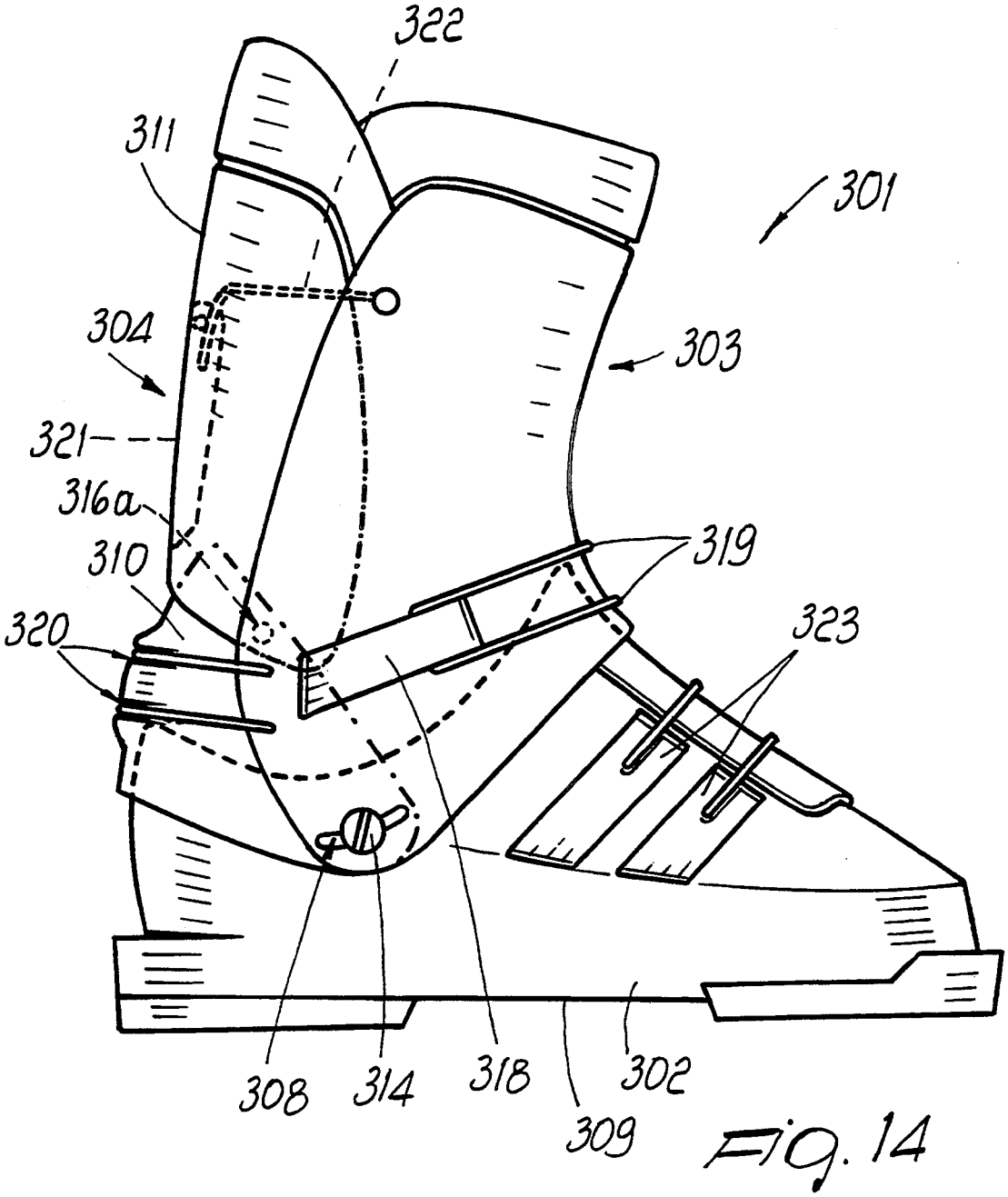
FIG. 14 is a side view of a ski boot according to a further aspect of the invention.
Figure 15:
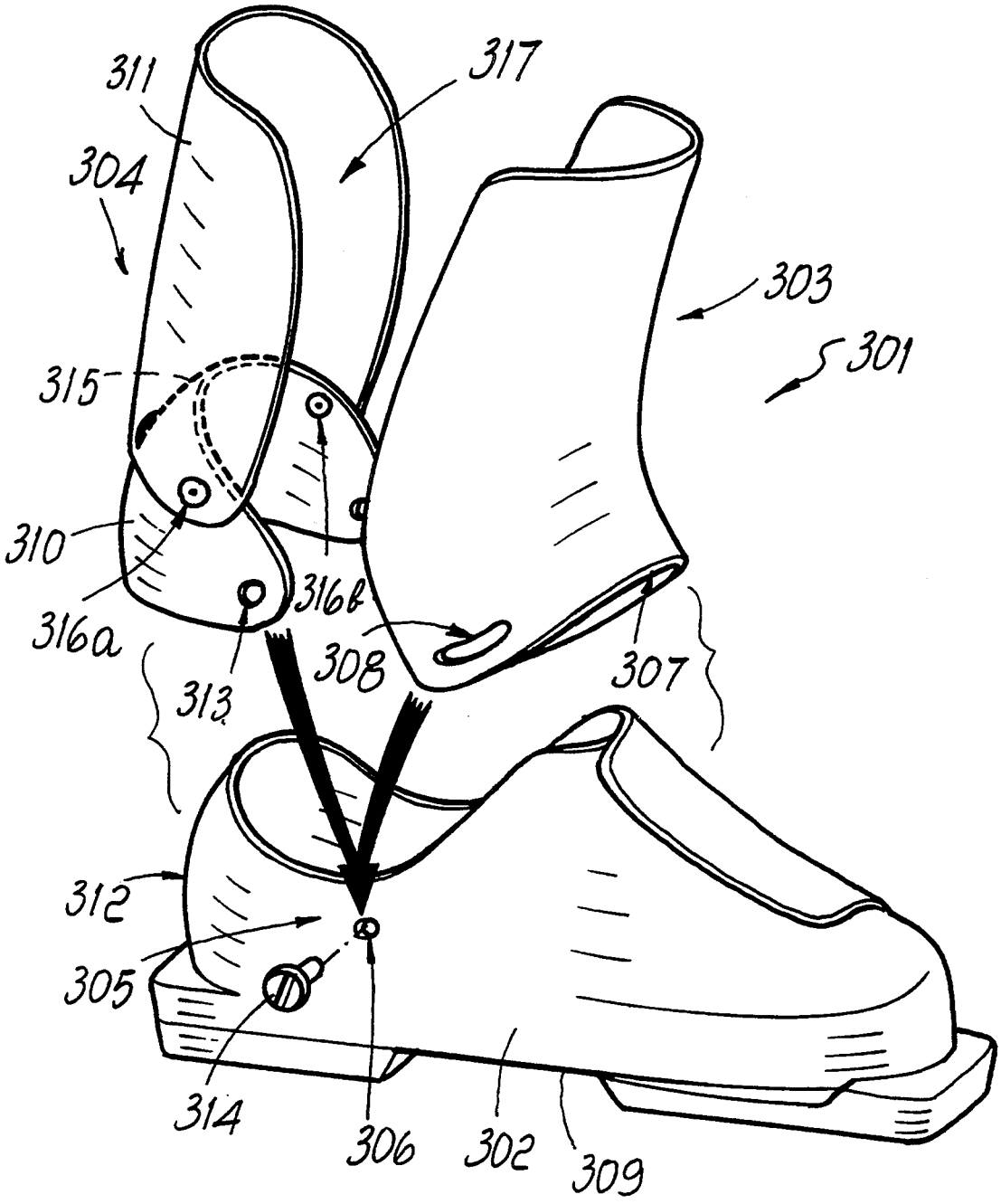
FIG. 15 is an exploded view of the ski boot of FIG. 14.

With reference to FIGS. 14–15, a ski boot, generally designated by the reference numeral 301, is constituted by a front quarter 303 and a rear quarter 304 associated with a shell 302.

A first pair of through holes 306 is defined to the rear of, and transversely to, the shell 302 proximate to the malleolar region 305.

A pair of first through slots 308 is defined on the front quarter 303 proximate to the lower perimetric edge 307; the slots preferably have an arcuated shape so as to allow the oscillation thereof with respect to the shell.

The rear quarter 304 is constituted by a second cuff, or half-quarter, 310 and by a first cuff, or half-quarter, 311; the second cuff 310 is arranged outside the shell 302 at the heel region 312 and is shaped complementarily thereto.

A second pair of through holes 313 is defined at the ends of the first cuff 310; said holes act as seats for a first pair of pivots 314 for the pivoting of both said second cuff and said front quarter 303 to the shell 302.

The first cuff 311 is pivoted to the second cuff 310 proximate to the upper perimetric edge 315 by means of a first pair of rivets 316a and 316b and embraces the calf region 317.

First securing means are furthermore provided and affect said first front quarter 303 and said second cuff 310; they are advantageously constituted by a first lever 318 which is associated laterally to the front quarter 303 and applies tension to one or more traction elements such as first cables 319.

Said first cables are connected to the first lever 318, then embrace the front quarter 303 and the second cuff 310 and are then reconnected laterally to the front quarter 303.

Guiding and supporting means for the cables 319 are provided at the second cuff 310 and are constituted by a pair of first seats 320 which are defined transversely and to the rear of the second cuff 310.

The first cuff 311 is connected to the front quarter 303 by virtue of second securing means such as a second lever 321 whose closure applies tension to second cables 322 which are connected laterally to the front quarter 303 at their free ends.

Third levers 323 for securing the shell and/or the front quarter 303 may also be provided.

The use of the invention is as follows: once the foot has been inserted in the boot and has been secured by means of the adapted levers, the closure of the first lever 318 imposes an oscillation to the front quarter 303 toward the heel, by virtue of the presence of the pair of slots 308, thus closing the foot instep, and simultaneously a rotation, also toward the heel, of the second cuff 310 about the axis of the first pair of pivots 314, by virtue of the application of tension to the first cables 319, thus closing the heel.

The embracing of the front quarter 303 and of the second cuff 310 by the first cables 319 furthermore allows to avoid the splaying thereof during flexing, ensuring that the ankle remains firmly supported during all the phases of skiing.

It has thus been observed that the invention has achieved the above described aim and objects, a ski boot having been provided which allows to achieve an optimum securing of the skier's ankle during skiing without requiring a direct intervention by the skier.

The ski boot according to the invention furthermore allows to maintain optimum securing for the ankle region also during the walk required, for example, to reach the ski-lift, during which the first cuff 311 is released with respect to the front quarter 303 by opening the second lever 321.

A similar situation is observed during flexings imposed to the front quarter 303.

Figure 16:
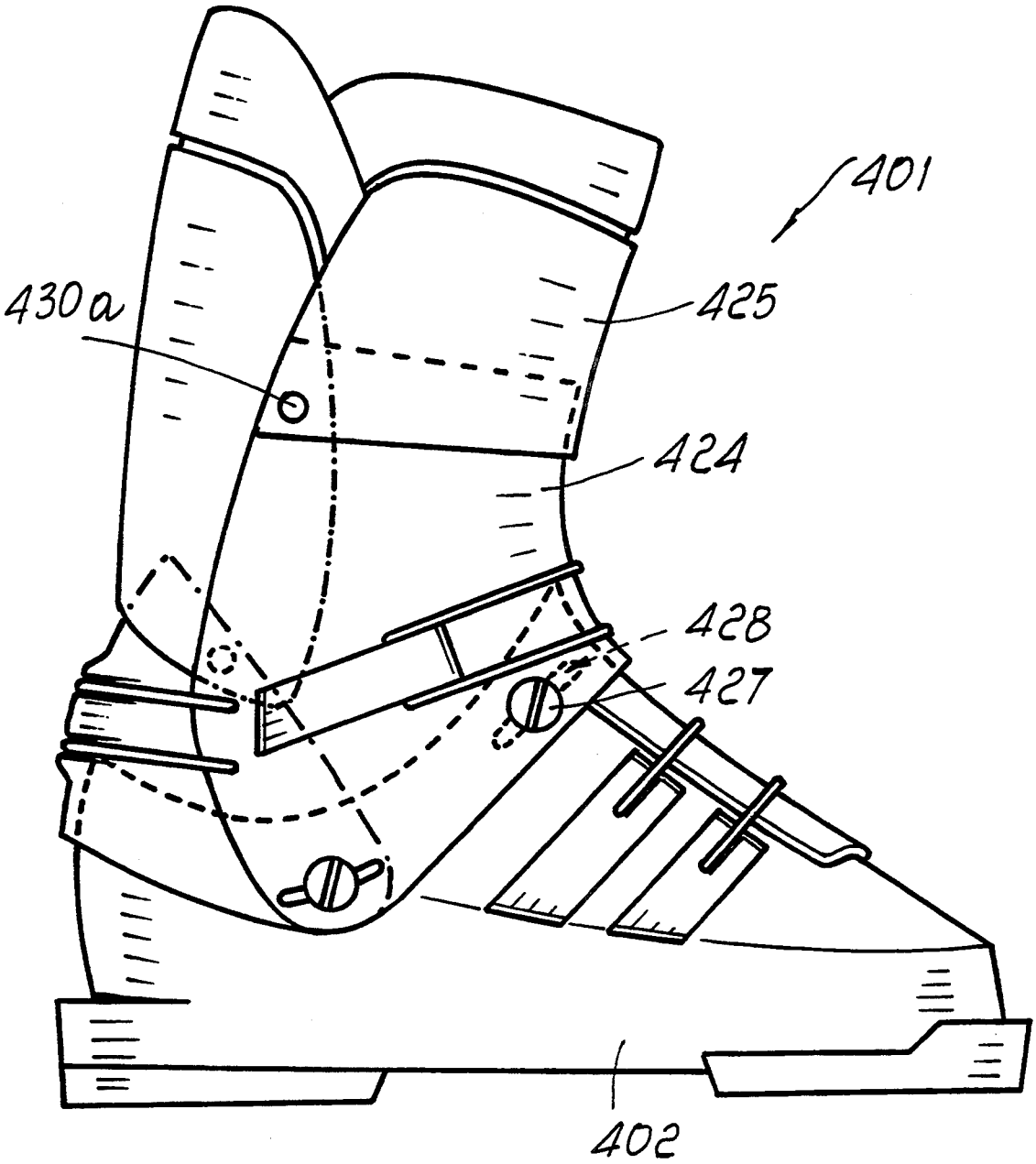
FIG. 16 is a side view of a ski boot according to still a further aspect of the invention.
Figure 17:
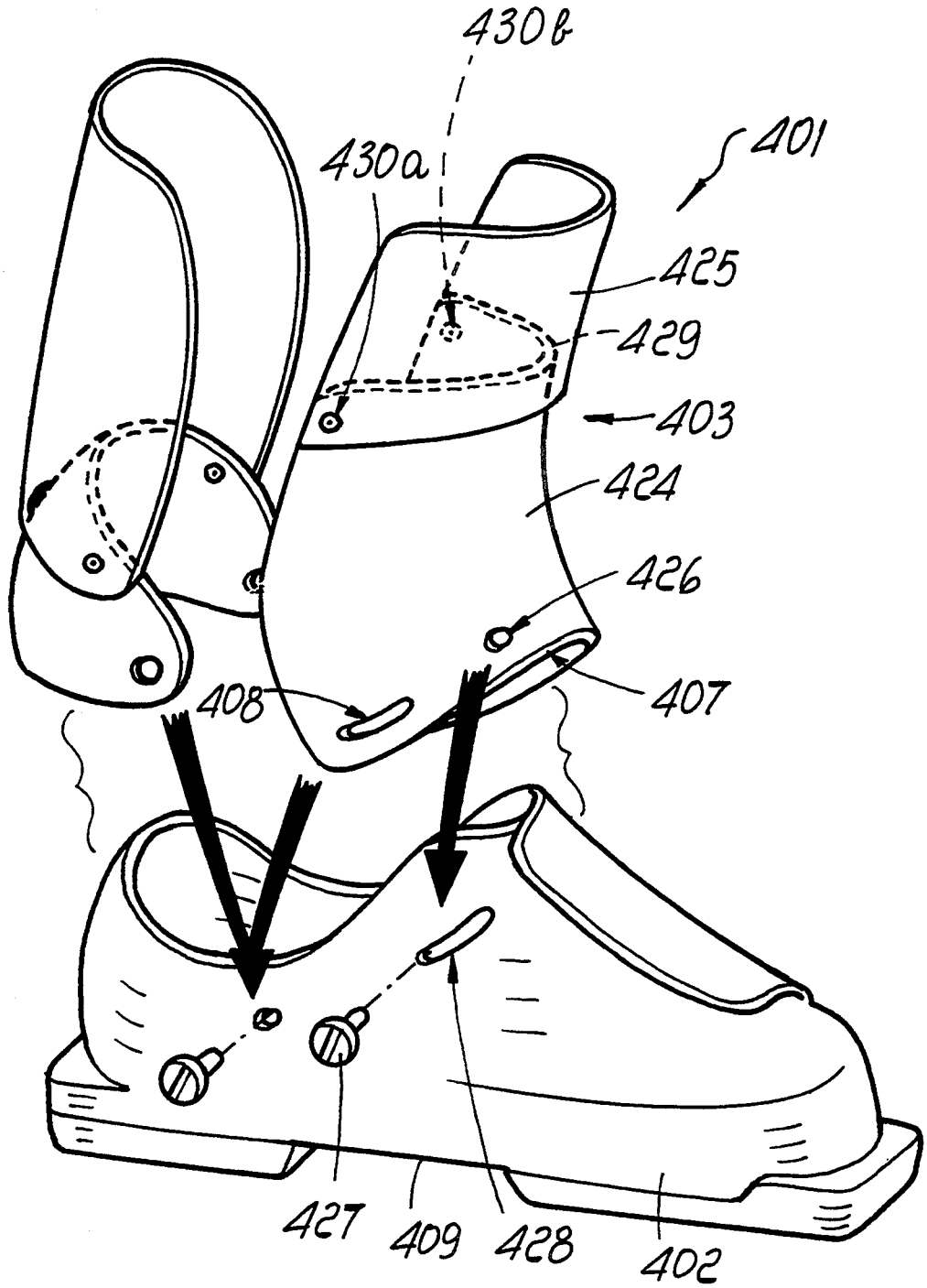
FIG. 17 is an exploded view of the ski boot of FIG. 16.

FIGS. 15–16 show a ski boot 401 having a front quarter 403 which is constituted by a third half-quarter, or cuff, 424 and by a fourth half-quarter, or cuff, 425.

A third pair of through holes 426 is defined on said third cuff 424 proximate to the lower perimetric edge 407 and to the first pair of slots 408; said holes act as seats for a second pair of pivots 427 for pivoting to the shell 402.

A second pair of slots 428 is defined on said shell at the axis of said second pair of pivots 427; the slots are preferably concave.

The fourth cuff 425 is freely pivoted proximate to the upper perimetric edge 429 of the third cuff 424 by means of a pair of second rivets 430a and 430b and affects the tibial region.

The ski boot according to the invention is susceptible to numerous modifications and variations, all of which are within the scope of the inventive concept.

The materials and the dimensions which constitute the individual components of the device may of course vary according to the specific requirements.

We claim:

1. Ski boot comprising a shell, a front quarter, and a rear quarter, said rear quarter comprising at least a first half-quarter arranged at a calf region of the ski boot and a second half-quarter arranged at a heel region of the ski boot, the ski boot further comprising connection means for connecting the front quarter to the shell, the ski boot further comprising first means for articulating said second half-quarter to said shell about a first axis and second means for articulating said first half-quarter to said second half-quarter about a second axis, the ski boot further comprising adjusting means for adjusting the releasable mutual relative position of said first and second half-quarters in a closed skiing position and for adjusting the releasable mutual relative position of said rear quarter with respect to said front quarter in the closed skiing position, said adjusting means allowing for unblocked rotation of said second half-quarter with respect to said shell in the closed skiing position said adjusting means comprising a first lever pivoted to said front quarter and a first cable element which is connected to said first lever, said first cable element slidably engaging said front quarter at a foot instep region of the boot and extending laterally around the ski boot and rearwardly around said second half-quarter at the heel region, the first cable element having an end connected laterally to said front quarter.

2. The ski boot according to claim 1, wherein said first articulating means comprise a first pair of lateral pivots and said second articulating means comprise a second pair of lateral pivots.

3. The ski boot according to claim 1, wherein said first articulating means comprise a first pair of lateral pivots and said second articulating means comprise a second pair of lateral pivots, said front quarter being provided with a first pair of slots in which said first pair of lateral pivots are slidably accommodated.

4. The ski boot according to claim 1, wherein said first articulating means comprise a first pair of lateral pivots and said second articulating means comprise a second pair of lateral pivots, said front quarter being provided with a first pair of slots in which said first pair of lateral pivots are slidably accommodated, said shell being provided with a second pair of slots and said front quarter being provided with a pair of lateral holes, the ski boot further comprising a third pair of lateral pivots accommodated in said lateral holes and slidably accommodated in said second pair of slots.

5. The ski boot according to claim 1, wherein said adjusting means comprise at least one traction element interconnected between said first half-quarter and said front quarter of the ski boot.

6. The ski boot according to claim 1, wherein said adjusting means further comprise a second lever pivoted rearwardly to said first half-quarter and a second cable element interconnected between said first half-quarter and said front quarter.

7. The ski boot according to claim 1, wherein said front quarter comprises a lower third half-quarter and an upper fourth half-quarter, the fourth half-quarter being pivotally connected to said third half-quarter about a transverse axis.

8. The ski boot according to claim 1, wherein said connection means are means for articulating said front quarter to said shell.

* * * * *